US006642642B1

(12) United States Patent
Watanabe et al.

(10) Patent No.: US 6,642,642 B1
(45) **Date of Patent: *Nov. 4, 2003**

(54) COLOR CATHODE RAY TUBE HAVING CURVED SHADOW MASK WITH ARRANGEMENT OF HOLES THEREIN AND IMPROVED MECHANICAL STRENGTH

(75) Inventors: Mitsuru Watanabe, Mutsusawa (JP); Katsuyoshi Tamura, Mobara (JP)

(73) Assignee: Hitachi, Ltd., Tokyo (JP)

( * ) Notice: Subject to any disclaimer, the term of this patent is extended or adjusted under 35 U.S.C. 154(b) by 309 days.

This patent is subject to a terminal disclaimer.

(21) Appl. No.: 09/604,248

(22) Filed: Jun. 27, 2000

(51) Int. Cl.[7] ..... H01J 29/80
(52) U.S. Cl. ..... 313/402; 313/403
(58) Field of Search ..... 313/402, 403, 313/408

(56) References Cited

U.S. PATENT DOCUMENTS 4,794,299 A * 12/1988 Chiodi et al. ..... 313/402
5,917,273 A * 6/1999 Watanabe et al. ..... 313/402
6,208,067 B1 * 3/2001 Nakagawa et al. ..... 313/402
6,342,759 B1 * 1/2002 Hosotani ..... 313/402
6,486,596 B1 * 11/2002 Inoue et al. ..... 313/402

FOREIGN PATENT DOCUMENTS

JP 57-34640 2/1982

* cited by examiner

*Primary Examiner*—Vip Patel
*Assistant Examiner*—Matt Hodges
(74) *Attorney, Agent, or Firm*—Antonelli, Terry, Stout & Kraus, LLP

(57) ABSTRACT

A color cathode ray tube includes in combination an in-line type electron gun assembly and a dot type phosphor screen, wherein an outer panel surface is made substantially flat, an inner surface is curved and a shadow mask has round apertures or holes while having a curved shape with a convex form as projected toward the panel. The display tube is featured in that the shadow mask holes have a horizontal direction pitch Ph and vertical direction pitch Pv, that the horizontal pitch Ph has a value at terminate ends of a minor axis of the shadow mask, which value is at least 5% greater than a pitch value at the center part of the shadow mask, and that a Ph/Pv value at the shadow mask minor axis ends is greater than that at the shadow mask center. With such an arrangement, it is possible to increase the mechanical strength at a part adjacent to the shadow mask minor axis in particular.

25 Claims, 6 Drawing Sheets

COLOR CATHODE RAY TUBE HAVING CURVED SHADOW MASK WITH ARRANGEMENT OF HOLES THEREIN AND IMPROVED MECHANICAL STRENGTH

BACKGROUND OF THE INVENTION

Flattening an outer panel surface of a color cathode ray tube makes it possible to improve viewability of on-screen picture images. However, in Braun tubes of the shadow mask type, it is required that the effective surface section of a shadow mask be curved to a specified curvature in order to retain the required mechanical strength of such shadow mask. To this end, a scheme is known for adding a curvature to the inner surface of a panel opposing the shadow mask while at the same time flattening the outer panel surface. When the glass thickness at the panel periphery is greater than that at the center portion of the panel, however, the following problems tend to occur: (1) the resultant brightness or luminance intensity can decrease at peripheral portions of the display screen, and/or (2) the ease of manufacture of the panel can be reduced. Accordingly, in cases where the outer panel surface is made flat, it is not permissible to significantly enlarge the curvature of the inner panel surface. In this case, it is impossible or at least very difficult to employ a shadow mask which exhibits any sufficient curvature, which results in the occurrence of a problem as to unwanted reduction in the mechanical strength of the shadow mask.

One prior known approach to improving the strength of a shadow mask with less curvature (with an increased radius of curvature) is to employ a technique for forming beads or alternating irregular bent/curved portions within the effective surface area of such shadow mask, as disclosed for example in U.S. Pat. No. 5,506,466. This prior art approach has the inherent problem that the beads and/or irregular curved/bent portions of the shadow mask badly affect the image display to cause a visually appreciable projection onto the phosphorus layer or phosphor screen associated therewith.

U.S. Pat. No. 4,136,,300 discloses a panel structure having inner and outer surfaces that are flat, which employs a technique for giving a shadow mask a curvature by varying the pitch of such shadow mask. This US patent, however, fails to provide teachings as to a panel structure that includes an in-line type electron gun and a dot type phosphor screen. Additionally, while this document sets forth therein a method of forming a curvature for a shadow mask in case an inner panel surface is made flat with a slot type shadow mask, it involves no discussion of the problems occurring when the panel is reduced to practice or to any detailed arrangement thereof.

A technique for changing the electron beam spacing (known as "S-size" among those skilled in the art) with a change in deflection angle in order to let the curvature of such shadow mask be greater than that on the inner panel surface has been disclosed in the International Display Workshop (IDW) 1998 at pp. 413–416. This technique as taught thereby does require the use of more than one electromagnetic quadrupole for causing the S-size to vary with a change in deflection angle.

U.S. Pat. No. 5,479,068 discloses a Braun tube with an inline type electron gun assembly and a dot type phosphor screen, which incorporates a technique for enlarging the longitudinal pitch values of shadow mask apertures or holes to thereby improve the color purity tolerances, while simultaneously increasing the electron beam transmissivities. Regrettably, U.S. Pat. No. 5,479,068 is silent about any curved shadow mask designs and also strength retainment schemes relating thereto.

SUMMARY OF THE INVENTION

The present invention is directed to a specific color cathode ray tube (color picture tube) of the type which includes a substantially flat outer panel surface with an inner panel surface and a shadow mask having a curvature, and is aimed at improvement in mechanical strength at or near a short or "minor" axis by letting the curvature of the shadow mask be large at a portion which is adjacent to the minor axis in particular.

To this end, the color cathode ray tube incorporating the principles of the invention is specifically arranged so that, in combination with an in-line type electron gun assembly and a dot type phosphor screen, a horizontal direction pitch value at upper and lower portions at or near the minor axis of a shadow mask is greater by five percent (5%) or above, preferably 10% or more, than a horizontal direction pitch value at the center of the shadow mask, while at the same time causing a ratio of the shadow mask's vertical pitch to the horizontal pitch thereof to be less in value at the upper and lower portions in close proximity to the shadow mask minor axis than at the center of the shadow mask.

DETAILED DESCRIPTION OF THE PREFERRED EMBODIMENT

Figure 1:
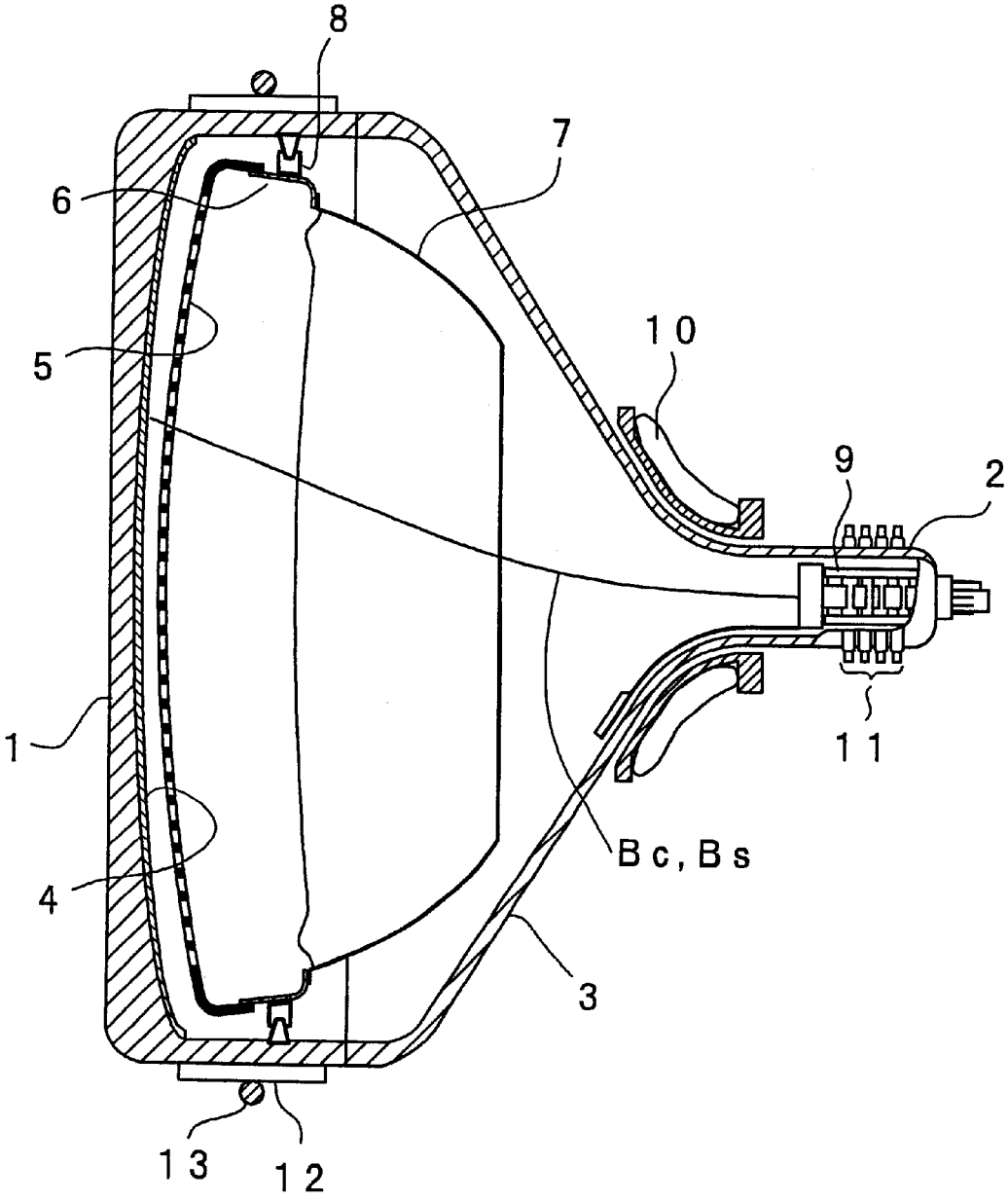
FIG. 1 is a diagram schematically showing a color cathode ray tube of the present invention.

Referring now to FIG. 1, there is shown in cross-section a 20V type color cathode ray tube (color display tube) in accordance With one preferred embodiment of the present invention. A panel 1 is formed such that its outside or outer surface is made flat and an inner surface is formed into a curved plane. A neck portion 2 accommodates therein an in-line type electron gun and is connected to the panel 1 via a funnel portion 3. A layer of phosphorous material of the dot type is formed on the inside surface of the panel 1 to constitute a phosphor screen 4. A shadow mask 5 has a large number of circular like apertures or round holes and is stably held by a support frame 6, which is attached by springs 8 to the panel 1. The shadow mask has an effective area with a number of apertures or holes for passing the electron beams therethrough.

An internal magnetic shield 7 is mounted on the support frame 6. A deflection yoke 10 is provided for deflecting electron beams, while a magnet assembly 11 operates to perform convergence and purity control/adjustment of the electron beams. A reinforcing or "tension" band 12 is provided for prevention of accidental implosion of the glass bulb. Flattening the outer panel surface while letting the inner panel surface have a curvature is effected in order to permit the shadow mask to likewise have a curvature. Whereas the panel's inner plate thickness at its central part measures 12 millimeter (mm), the glass plate thickness at the periphery of the panel is greater in value than the thickness at the center of such panel due to the presence of a difference in curvature between the inner and outer panel surfaces. In cases where the panel's diagonal effective diameter is 508 mm, a definition equation Zo of the outer panel surface is represented by:

$$Zo(x,y)=R_x-\{(R_x-R_y+(R_y^2-y^2)^{1/2})^2)-x^2)\}^{1/2}$$

where $R_x$=50,000 mm, and $R_y$=80,000 mm. In addition a definition equation Zi of the inner panel surface is given as:

$$Zi(x,y)=R_x-\{(R_x-R_y+(R_y^2-y^2)^{1/2})^2)-x^2)\}^{1/2}$$

where $R_x$=1,990 mm, $R_y$=1,870 mm. With the panel thus arranged, the radius of curvature becomes different in value depending upon locations thereon.

Figure 2:
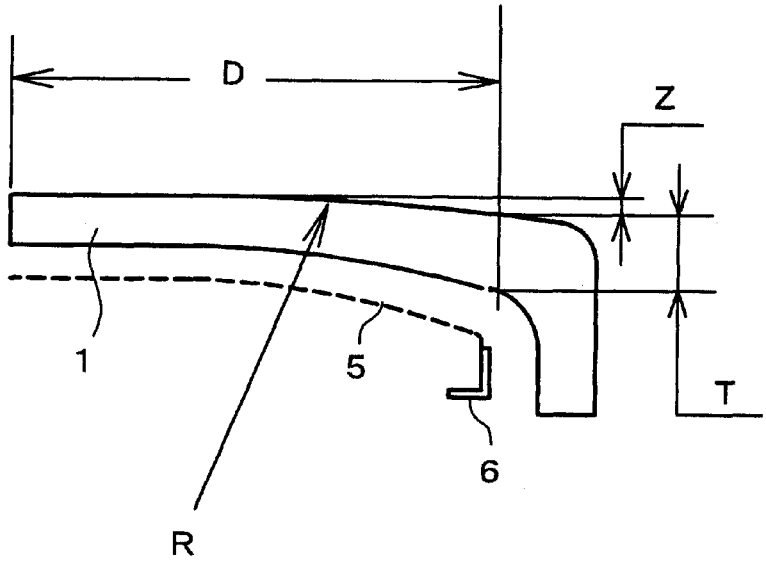
FIG. 2 is a cross-sectional view of a portion of a panel.

Accordingly, as shown in FIG. 2, an equivalent radius of curvature R is defined using a drop-down amount as follows:

$$R=(D^2+Z^2)/(2Z)$$

where D is -a half length of the effective diameter, and Z is a difference in height between the panel's center and effective surface edge portion. This equivalent radius of curvature is definable using a long or "major" axis, short or "minor" axis, and a diagonal axis. The equivalent radius of curvature in the panel's diagonal direction, as defined by the R value discussed above, is 62,500 mm, whereas the equivalent radius of curvature in the minor axis direction is 77,000 mm.

Generally, if the equivalent radius of curvature of the outer panel surface is 10,000 mm or above, then the resultant surface is seen to be flat to the human eye.

In the case of such a panel with a flat outer surface, the resulting mechanical strength of the shadow mask, especially the strength at certain portions adjacent to the minor axis, is problematic and thus is to be carefully considered. Enlarging the panel's plate thickness at peripheral portions to form the inner panel surface into a curved plane makes it possible for the shadow mask to have a similar curved plane. In the panel by the as defined above equations, the equivalent radius of curvature along the minor axis at the inner surface is 1,866 mm. If the difference in glass plate thickness between the center and periphery is significant, then the following penalties would arise: a difference in brightness between the center and periphery increases accordingly; and the resultant display screen lacks flatness due to the influence of the curved plane of the inner panel surface. In this case, the plate thickness difference between the center and a 150 mm face area along the periphery measures 6.04 mm whereas a ratio relative to the center glass plate thickness is approximately 50.3 percent (%).

An example of a corresponding shadow mask curved plane Z will be set forth below.

$$Z(x,y)=A1x^2+A2x^4+B1y^2+B2x^4+C1x^2y^2+C2x^4y^2+C3x^2y^4+C4x^4y^4$$

Here, those values of respective coefficients from Al to C4 are as shown in Table 1 below.

TABLE 1

| Coefficients | Values | Coefficients | Values |
|---|---|---|---|
| A1 | $0.3177 \times 10^{-3}$ | A2 | $0.7237 \times 10^{-9}$ |
| B1 | $0.2176 \times 10^{-3}$ | B2 | $0.5224 \times 10^{-9}$ |
| C1 | $-0.4310 \times 10^{-9}$ | C2 | $-0.1219 \times 10^{-13}$ |
| C3 | $0.1951 \times 10^{-13}$ | C4 | $-0.3501 \times 10^{-18}$ |

The curved plane shown in Table 1 is obtainable when the shadow mask's horizontal direction pitch 1.8 kept at a substantially constant value of 0.41 mm on the minor axis. The curvature on the shadow mask minor axis may be represented by coefficients B1, B2 in this case, and the equivalent curvature radius on the minor axis is 2,190 mm.

Figure 3:
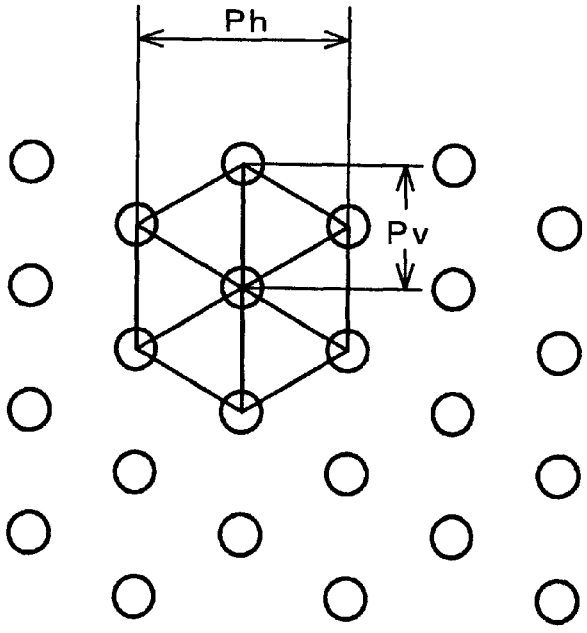
FIG. 3 is a diagram which depicts a layout of shadow mask apertures or holes.

A definition of hole pitch values of the shadow mask is shown in FIG. 3. Ph is a horizontal direction pitch; Pv is a vertical direction pitch. In light of the fact that the shadow mask has less strength at certain portions adjacent to the minor axis, it should be required that the radius of curvature near the minor axis be reduced in value in order to increase the strength at such portions. In a combination of the shadow mask and the panel, the "q" size measures 10 mm in a specified location on the minor axis, which is spaced apart by 145 mm from the center. Note here that the q-size is a distance between the panel and the mask. In the case of the in-line electron beam layout, this value is determinable based on the spacing between adjacent electron beams at the deflection center and the distance between the deflection center and phosphor screen plus the horizontal direction pitch of the shadow mask holes.

At the specified location on the minor axis, which is spaced apart by 145 mm from the center, when the shadow mask's horizontal direction pitch is increased by 5% up to 0.431 mm, the q-size also increases by about 5% to reach 10.5 mm. In this case, the drop-down amount at the 145 mm location on the shadow mask minor axis increases by 0.5 mm; thus, the resultant radius of curvature becomes 1,984 mm and this value is about 91% of the radius of curvature obtained when the horizontal direction pitch is kept constant in value. Alternatively, when the horizontal direction pitch Ph is increased by 10% up to 0.451 mm, the equivalent curvature radius becomes 1,813 mm, which is about 83% of the radius of curvature obtained when the horizontal direction pitch stays constant.

The radius of curvature reduction due to an increase in horizontal direction pitch Ph makes it possible for the shadow mask to have an improved mechanical strength accordingly. Adversely, in case the shadow mask's radius of curvature does not need to be changed, it is possible to reduce the glass plate thickness at the periphery. Since an ability to lessen a difference in panel glass thickness between the center and the periphery may in turn make it possible to suppress or minimize any possible brightness irregularities of on-screen display images between the panel center and its periphery otherwise occurring due to an optical transmissivity difference of the glass, the use of chosen glass materials high in optical absorptivity, including, but not limited to, so-called "tint" or "dark tint" materials, makes it possible to improve the contrast of such display images. Additionally, the transmissivity in the case of a glass plate thickness of 10.16 mm is 57% for the tint glass material, and 46% for the dark-tint glass material.

While the horizontal direction pitch Ph at major axis edges of the shadow mask is determinable in a way independent of the horizontal direction pitch Ph of major axis edges, it will be preferable that the horizontal direction pitch Ph of major axis edges be equal to or greater in value than the horizontal direction pitch Ph at the center.

A typical known approach to obtaining and retaining an electron beam landing tolerance or margin required while letting phosphors have a dense structure is to design the layout of shadow mask holes so that it consists essentially of an ensemble of triangular patterns as shown in FIG. 3. In this case a relation of the horizontal direction pitch Ph versus vertical direction pitch Pv is given by $Ph=\sqrt{3}Pv$. To maintain the intended dense structure of phosphors, it will also be considered effective to increase the vertical pitch along with the horizontal pitch at upper portions of the display screen; however, this tends to produce moire controlling hardness. Moire patterns take place due to interference with the periodicity of electron beam transmissivity closely related to both the scanning lines of electron beam and the longitudinal pitch of the shadow mask holes. Consequently, if the longitudinal pitch of the shadow mask holes becomes different in value between the center and the upper and lower portions on the effective screen area, then the moire control procedures become difficult over the entire area of the display screen.

Figure 4:
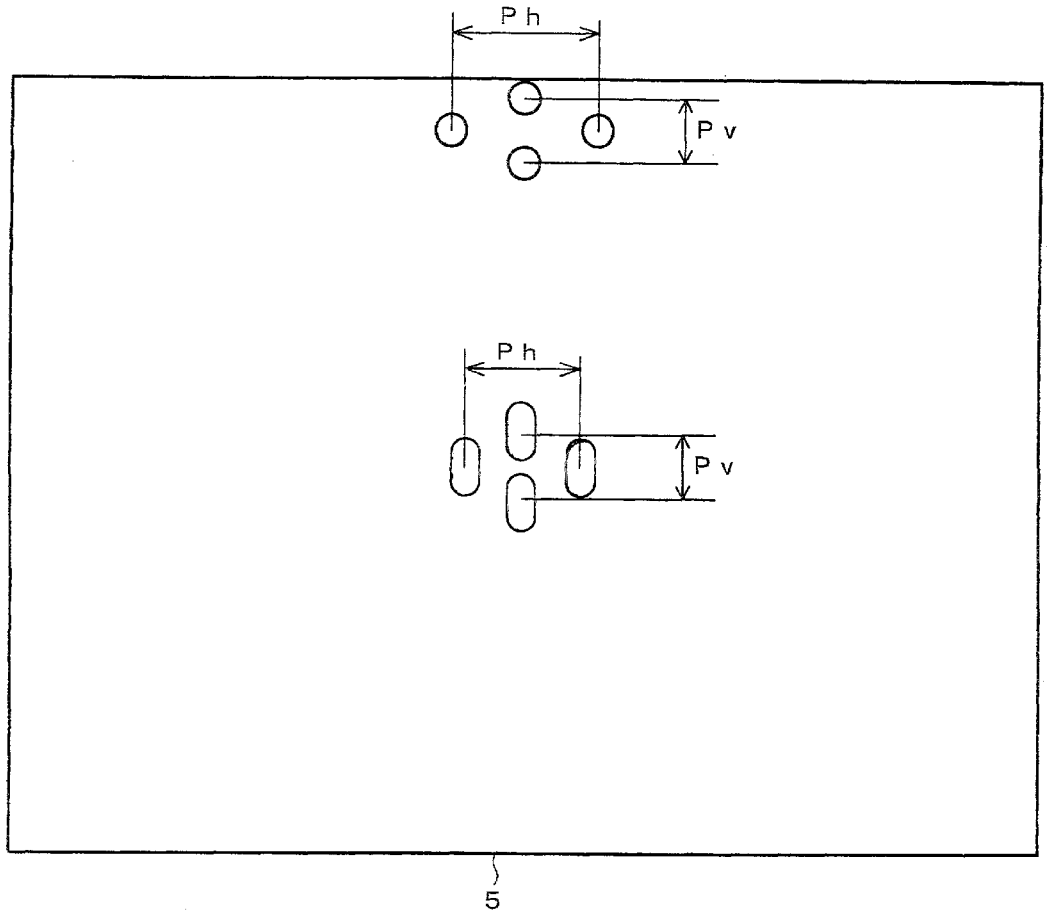
FIG. 4 is a diagram which shows an example of a mask hole layout pattern at the center of a shadow mask and also at the periphery thereof, wherein for illustration purposes, substantially circular holes are shown at the periphery and substantially longitudinally lengthened holes are shown at the center.

An important concept of the instant invention lies in precluding an increase in vertical pitch from exceeding an increase in horizontal pitch at specified portions, i.e. at upper and lower portions of the shadow mask. More specifically, as shown in FIG. 4, the intended moire controllability is achievable by causing the value Pv/Ph at upper or lower effective surface portions near the minor axis to stay smaller than the value at the center. While somewhat alterable depending on a relation with respect to the requisite number of scan lines, it can be said that moire control becomes easier in cases where the Pv value is less than 0.27 mm on the display screen as a whole. Exemplary values of the horizontal pitch Ph and vertical pitch Pv at the center of effective area of the shadow mask and also at the upper and lower portions of such shadow mask effective area are as shown in Table 2 below.

TABLE 2

| Measurement Position | Ph | Pv |
|---|---|---|
| Center | 0.41 mm | 0.237 mm |
| Upper/Lower Portions of Effective Surface | 0.451 mm | 0.237 mm |

Figure 5:
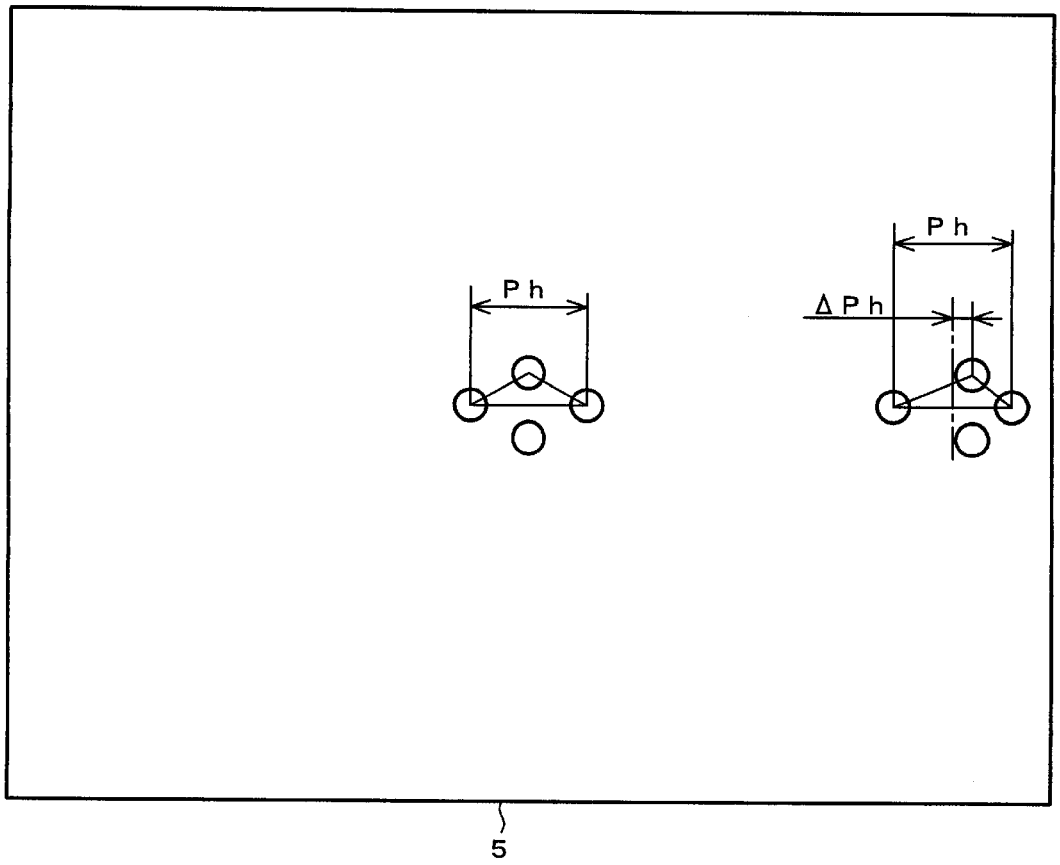
FIG. 5 is a diagram which shows an exemplary layout pattern of shadow mask holes with one being offset in position from an isosceles triangular formation.

Upon changing of the horizontal pitch of the shadow mask with respect to the minor axis direction only, a trio of hole layout pattern is deformed from the intended isosceles triangle at certain locations along a shadow mask side edge as diagrammatically shown in FIG. 5, resulting in a decrease in color purity tolerance.

Figure 6:
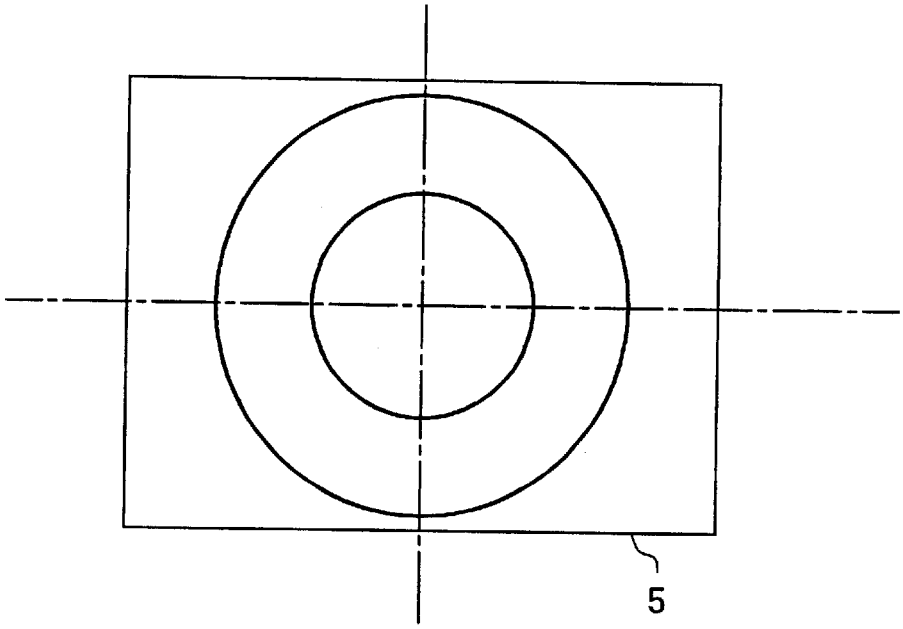
FIG. 6 is a diagram which shows an example with a horizontal direction pitch of shadow mask holes being the same at those points on a concentric circle of the shadow.

To prevent this, the horizontal pitch Ph is allowed to change in the shadow mask major axis direction also in a way similar to that in the minor axis direction thereof. After all, this procedure means that the horizontal pitch is rendered identical in value with respect to an extended surface area ranging from the center up to those portions overlying the circumference. In other words, the same horizontal pitch is established on a circle shown in FIG. 6. In this case, a problem occurs as to an unwanted decrease in on-screen image resolution in the horizontal direction at diagonal peripheral portions of the shadow mask.

The present invention may avoid this problem by using a specific, as which follows. The layout pattern of shadow mask holes is longitudinally lengthened or elongated at a selected part in close proximity to the center. More specifically, the relation of $Ph<\sqrt{3}Pv$ is established while letting Ph be less in value in advance. Since the electron beam mislanding problem is relatively insignificant at the shadow mask center, it is permissible that Ph be made smaller significantly. It is by no means difficult to let the relation of the horizontal pitch Ph versus vertical pitch Pv satisfy $Ph\leqq 6.9\sqrt{3}Pv$. With such an arrangement, it is possible to prevent significant degradation of horizontal direction image resolution at diagonal peripheral portions of the screen. A practical value example is indicated in Table 3. With this example, $Ph=0.85\sqrt{3}Pv$ is defined at the center of shadow mask whereas $Ph=\sqrt{3}Pv$ is defined at a diagonal periphery. In this example, a grading of 10.6% is added in the minor axis direction, whereas 17.7% grading is provided in diagonal directions. The term "minor axis upper and lower portions" as used in the tables below may refer to a location or locations spaced part by 3 mm from the effective area's edge on the shadow mask minor axis; and the term "diagonal periphery" is to be understood to mean those locations that are 5 mm distant from, edges of the effective area on the shadow mask's diagonal axis.

TABLE 3

| Position | Ph | Pv |
|---|---|---|
| Center | 0.384 mm | 0.261 mm |
| Minor Axis Upper and Lower Portions | 0.425 mm | 0.261 mm |
| Diagonal Periphery | 0.452 mm | 0.261 mm |

There is also available an alternative way of designing the hole layout into a laterally lengthened or "fat" pattern at the diagonal periphery to thereby attain balancing of the degree of longitudinal length at the center. Table 4 below shows an example with $Ph=0.93\sqrt{3}Pv$ defined at the shadow mask center and with $Ph=1.03\sqrt{3}Pv$ defined at a diagonal periphery.

TABLE 4

| Position | Ph | Pv |
|---|---|---|
| Center | 0.420 mm | 0.261 mm |
| Diagonal Periphery | 0.466 mm | 0.261 mm |

At the center, it will be further possible to let $Ph<0.85\sqrt{3}Pv$. Note here that if the shadow mask hole layout is noticeably deviated from an equilateral triangular shape, then the beam landing margin decreases, resulting in a need being felt to lessen the diameter of the shadow mask holes. In this case the brightness or luminance intensity can decrease. When elongating the hole shape also in a way pursuant to deformation of the hole layout into a longitudinally lengthened shape. it becomes possible to improve the resultant brightness. With the hole layout shown in Table 3, it is possible for the hole shape to be longitudinally lengthened at certain portions at the shadow mask center along with the upper and lower portions on the minor axis.

Figure 7:
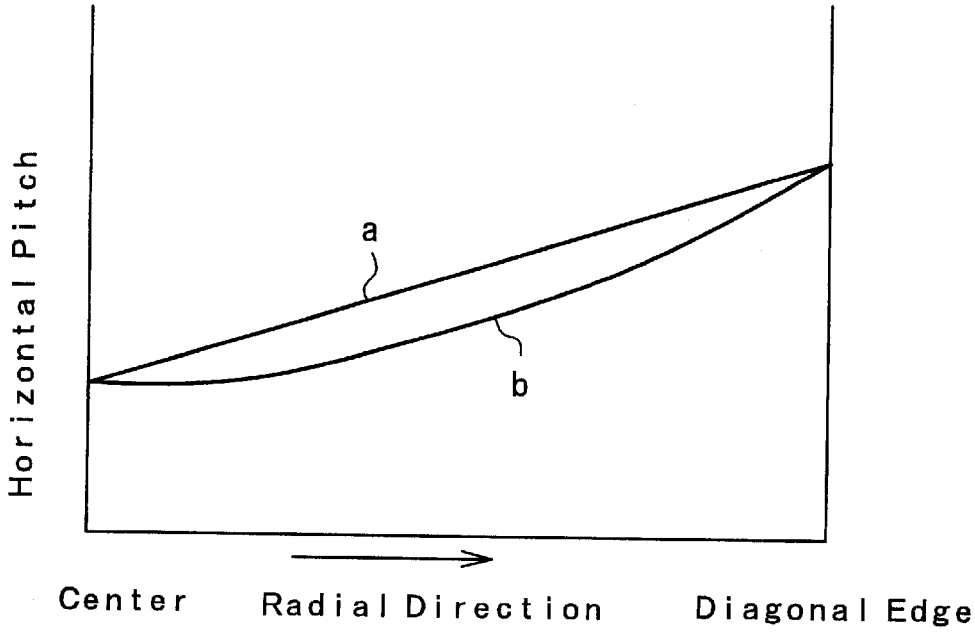
FIG. 7 is a graph showing a grading of horizontal direction pitch values of shadow mask holes.

A variety of methods may be employable to accomplish the grading of horizontal pitch Ph. One example is shown in FIG. 7. In FIG. 7, reference character "a" is used to indicate a case where the horizontal direction pitch Ph is linearly variable in value whereas "b" shows a case where the horizontal direction pitch Ph varies non-linearly, for example, quadrically or exponentially. From a viewpoint of maximizing the curvature toward the minor axis direction, an intermediate curved line shape between a line segment and quadratic curve is recommendable. So far as it is permissible that the horizontal direction pitch becomes coarser at the diagonal periphery and those portions adjacent to the major axis, the horizontal direction pitch may be made variable in value along a quartic curve or alternatively any possible curves representing a combination of quadric and quartic curves together.

Figure 8:
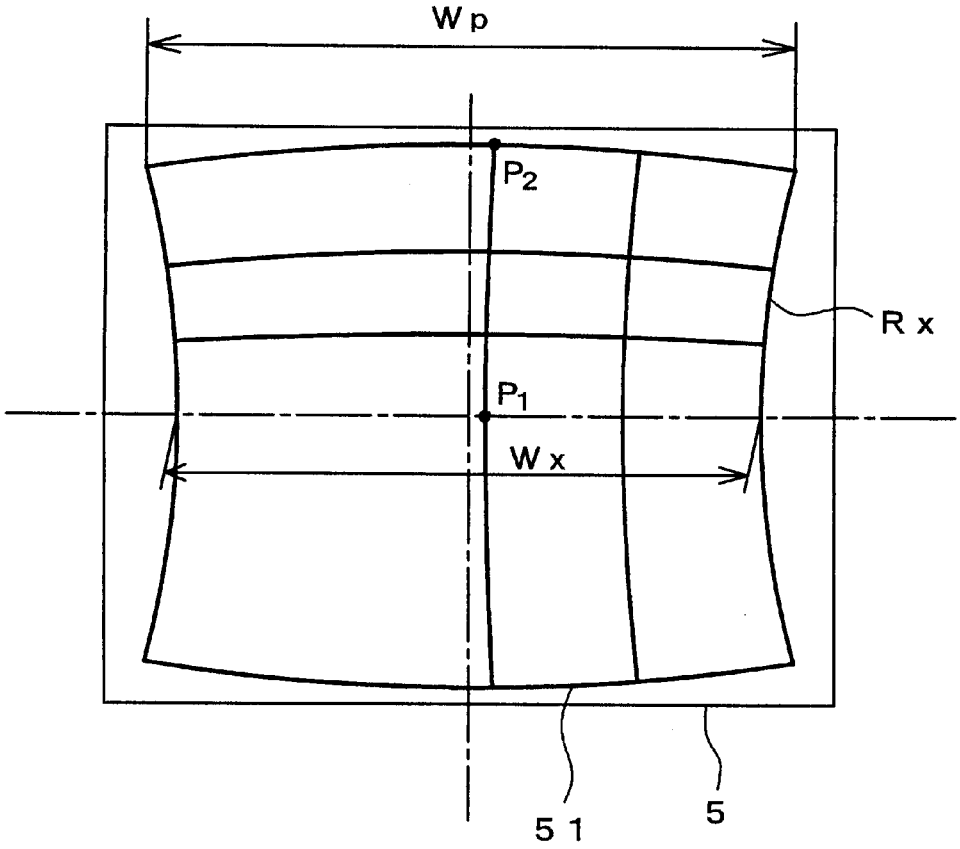
FIG. 8 is a diagram which shows an exemplary effective surface shape of the shadow mask.

One known shadow mask is shown in FIG. 8. A shadow mask effective area 51 is designed so that each of its longer sides is formed into a barrel-like shape, whereas each shorter side is in a pincushion-like shape. The use of such barrel-like shape for each long side is to let phosphor dots be identical to the inclination or gradient of the electron beams occurring at corner edges due to deflection yoke characteristics. The short sides are of the pincushion shape in order to form the outer shape of a phosphor screen into a substantially rectangular shape. Although shadow mask holes are present at specified portions overlying respective longitudinal layout lines, the vertical direction pitch Pv in this case also is such that its values on upper and lower short sides are greater than those on the major axis. However, the difference therebetween remains less to the extent that $Ph_p/Ph_x=W_p/W_x$ is definable, where $Ph_x$ is the horizontal direction pitch of a point P1 on the major axis, and $Ph_p$ is the horizontal direction pitch of point P2 on a long side. Here, $W_p$ is a maximal diameter in the horizontal direction at portions in close proximity to long sides of an effective area, and $W_x$ is a major axis diameter. In the exemplary 20 V type color display tube, $W_p$=394 mm, and $W_x$=391 mm. Thus, $Ph_p/Ph_x$ is 1.0077. When approximating the pin amount in FIG. 8 by use of the radius of a circle, the resultant value is 7,077 mm. The present invention is designed to let $Ph_p/Ph_x>W_p/W_x$ on a specified line extending in parallel to the minor axis of the shadow mask. Better results are obtainable if this relation is satisfied at locations adjacent to the minor axis. In addition, the longitudinal alignment lines of the shadow mask holes of the invention are such that there must exist a specific location with its pincushion being greater than a pincushion at short sides of the effective area 51. Additionally, the relation of $Ph_p/Ph_x>W_p/W_x$ will also be applicable to the case of $W_p<W_x$.

When the q-size is made greater at or near the periphery of the display screen, the influence of geomagnetism will become more significant. In particular, with large size tubes, this geomagnetic influence can often raise problems. To avoid this, a geomagnetism canceler coil 13 may be employed, as shown in FIG. 1. This coil may be formed of one or several turns of an electrical wire as wound around the panel's skirt portion in a similar way to that of the reinforcing band 12, also known as an anti-implosion band.

What is claimed is:

1. A color cathode ray tube comprising a panel having a substantially flat outer surface and an inner surface with a convex plane projected toward the outer surface, an in-line type electron gun assembly, a dot type phosphor display screen formed on the inner panel surface, and a shadow mask disposed to oppose said inner panel surface and having a convex plane projected toward said panel, said shadow mask having an effective area with a number of at least one of substantially circular holes and substantially longitudinally lengthened holes for passing electron beams, characterized in that said number of at least one of substantially circular holes and substantially longitudinally lengthened holes have a horizontal direction pitch Ph and a vertical direction pitch Pv, that Ph has a value at a terminate end of a minor axis of the shadow mask being at least five percent (5%) greater than a value at a center part of the shadow mask, that $Ph<\sqrt{3}Pv$ is defined at the shadow mask center, that Ph/Pv has a value at upper and lower end portions of the shadow mask minor axis being greater than a value at the center part of the shadow mask, and that the horizontal direction pitch Ph at an end of a major axis of the shadow mask is equal to or greater than the horizontal pitch at the center part of said shadow mask.

2. A color cathode ray tube according to claim 1, characterized in that an equivalent radius of curvature of said outer panel surface in a minor axis direction is greater than or equal to 10,000 millimeter (mm).

3. A color cathode ray tube according to claim 1, characterized in that said horizontal direction pitch is greater by 10% or above in value at ends of the minor axis than at center part of the shadow mask.

4. A color cathode ray tube according to claim 1, characterized in that an equivalent radius of curvature in a minor axis direction of the shadow mask at a part adjacent to a display screen minor axis is less than an equivalent radius of curvature in the minor axis direction of the inner surface of said panel.

5. A color cathode ray tube according to claim 1, characterized in that a shadow mask hole shape at a center part of said display screen is longitudinally lengthened.

6. A color cathode ray tube according to claim 1, characterized in that a shadow mask hole shape at upper and lower end portions near the display screen minor axis is longitudinally lengthened.

7. A color cathode ray tube according to claim 1, characterized in that the vertical direction pitch Pv is less than or equal to 0.27 mm with respect to the entirety of said display screen.

8. A color cathode ray tube according to claim 1, characterized in that a relation of the horizontal direction pitch Ph versus the vertical direction pitch Pv at the center part of the display screen is given by $Ph<0.93\sqrt{3}Pv$.

9. A color cathode ray tube according to claim 1, characterized in that a relation of the horizontal direction pitch Ph versus the vertical direction pitch Pv at the center part of the display screen is given as $Ph<0.85\sqrt{3}Pv$.

10. A color cathode ray tube according to claim 1, characterized in that the horizontal direction pitch Ph at a part adjacent to the minor axis is substantially quadric changeable with respect to a distance from the shadow mask center.

11. A colorcathode ray tube according to claim 1, characterized in that the horizontal direction pitch Ph is also changeable along a major axis of the shadow mask with a change amount variable at a rate of a quadric function or a function of higher order with respect to a distance from the shadow mask center.

12. A color cathode ray tube comprising a panel having a substantially flat outer surface and an inner surface with a convex plane projected toward the outer surface, an in-line type electron gun assembly, a dot type phosphor screen formed on the inner panel surface, and a shadow mask disposed to oppose said inner panel surface and having a convex plane projected toward said panel, said shadow mask having an effective area with a number of at least one of substantially circular holes and substantially longitudinally lengthened holes for passing electron beams, characterized in that said number of at least one of substantially circular holes and substantially longitudinally lengthened holes have a horizontal direction pitch Ph and a vertical direction pitch Pv, that Ph is substantially the same in value on a circumference with a shadow mask center being as its center, that $Ph<\sqrt{3}Pv$ is defined at the shadow mask center, and that Ph/Pv is greater in value at minor axis ends than at the shadow mask center.

13. A color cathode ray tube according to claim 12, characterized in that an equivalent radius of curvature of the outer panel surface in a minor axis direction is greater than or equal to 10,000 mm.

14. A color cathode ray tube according to claim 12, characterized in that the vertical direction pitch Pv is kept substantially constant relative to the entirety of the shadow mask.

15. A color cathode ray tube according to claim 12, characterized in that the vertical direction pitch is less than or equal to 0.27 mm over the entirety of the shadow mask.

16. A color cathode ray tube according to claim 12, characterized in that a relation of the horizontal direction pitch Ph versus the vertical direction pitch Pv at a center part of the shadow mask is given as $Ph \leqq 0.93\sqrt{3}Pv$.

17. A color cathode ray tube according to claim 12, characterized in that a relation of the horizontal direction pitch Ph versus the vertical direction pitch Pv at a center part of the shadow mask is given by $Ph \leqq 0.85\sqrt{3}Pv$.

18. A color cathode ray tube according to claim 12, characterized in that a relation of the horizontal direction pitch Ph versus the vertical direction pitch Pv at a diagonal periphery of the shadow mask is given as $Ph \approx \sqrt{3}Pv$.

19. A color cathode ray tube according to claim 12, characterized in that a shadow mask hole shape at the center of the shadow mask is longitudinally lengthened.

20. A color cathode ray tube according to claim 12, characterized in that a shadow mask hole shape at minor axis ends of the shadow mask is longitudinally lengthened.

21. A color cathode ray tube according to claim 12, characterized in that the horizontal direction pitch of the shadow mask is changeable as a quadric function or a function of lower order of a distance extending from the shadow mask center toward a radial direction.

22. A color cathode ray tube comprising a panel having a substantially flat outer surface and an inner surface with a convex plane projected toward the outer surface, an in-line type electron gun assembly, a dot type phosphor screen formed on the inner panel surface, and a shadow mask disposed to oppose said inner panel surface and having a convex plane projected toward said panel, said shadow mask having an effective area with a number of at least one of substantially circular holes and substantially longitudinally lengthened holes for passing electron beams, characterized in that said number of at least one of substantially circular holes and substantially longitudinally lengthened holes have a horizontal direction pitch Ph and a vertical direction pitch Pv, that a specific location exists on a line segment extending substantially parallel to a minor axis of the shadow mask at which location a horizontal direction pitch value $Ph_p$ of upper and lower ends are greater than a horizontal direction pitch value $Ph_x$ on a major axis, while permitting establishment of a relation of $Ph_p/Ph_x > W_p/W_x$, where $W_p$ is a maximal horizontal length in close proximity to a long side of an effective area of the shadow mask and $W_x$ is a diameter of the major axis, and that the horizontal direction pitch Ph at shadow mask major axis ends is equivalent to or greater than a horizontal direction pitch value at a center part of the shadow mask.

23. A color cathode ray tube according to claim 22, characterized in that at a part adjacent to the minor axis of the shadow mask, the horizontal direction pitch value $Ph_p$ at the shadow mask upper and lower ends is greater than the horizontal direction pitch value $Ph_x$ at the shadow mask center, while permitting establishment of a relation of $Ph_p/Ph_x > W_p/W_x$.

24. A color cathode ray tube according to claim 22, characterized in that $W_p > W_x$ is defined.

25. A color cathode ray tube according to claim 22, characterized in that an equivalent radius of curvature of said outer panel surface in a minor axis direction is greater than or equal to 10,000 mm.

* * * * *